US005171141A

United States Patent [19]

Morozumi et al.

[11] Patent Number: 5,171,141

[45] Date of Patent: Dec. 15, 1992

[54] SCROLL COMPRESSOR WITH DISTAL ENDS OF THE WRAPS HAVING SLIDING CONTACT ON CURVED PORTIONS

[75] Inventors: Naoya Morozumi, Tokyo; Tsugio Itami, Numazu; Hirotsugu Sakata, Chigasaki; Makoto Hayano, Tokyo; Toshiya Yajima, Yokohama; Teruo Kobuna, Kawasaki, all of Japan

[73] Assignee: Kabushiki Kaisha Toshiba, Kawasaki, Japan

[21] Appl. No.: 769,368

[22] Filed: Oct. 1, 1991

[30] Foreign Application Priority Data

Oct. 1, 1990 [JP] Japan ..... 2-263587

[51] Int. Cl.[5] ..... F04C 18/04

[52] U.S. Cl. ..... 418/55.2

[58] Field of Search ..... 418/55.2

[56] References Cited

U.S. PATENT DOCUMENTS

| | | | |
|---|---|---|---|
| 3,884,599 | 5/1975 | Young et al. | 418/55.2 |
| 4,141,677 | 2/1979 | Weaver et al. | 418/55.2 |
| 4,558,997 | 12/1985 | Sakata et al. | 418/55.2 |
| 4,781,459 | 11/1988 | Caillat | 418/97 |
| 4,886,433 | 12/1989 | Maier | 418/55.2 |
| 4,997,348 | 3/1991 | Kolb et al. | 418/55.2 |

FOREIGN PATENT DOCUMENTS

| | | | |
|---|---|---|---|
| 2160582 | 6/1973 | Fed. Rep. of Germany | 418/55.2 |
| 3716017 | 12/1987 | Fed. Rep. of Germany | 418/55.2 |
| 3727281 | 2/1989 | Fed. Rep. of Germany | 418/55.2 |
| 63-59032 | 11/1988 | Japan . | |

*Primary Examiner*—John J. Vrablik

*Attorney, Agent, or Firm*—Cushman, Darby & Cushman

[57] ABSTRACT

A scroll compressor comprises a first end member having an axis, a second end member facing the first end member, relatively movable crosswise of the first end member and having an axis, a bearing portion extending through either one of central portions of the first and second end members, a first scroll wrap formed in a vortical manner and extending from the face of the second scroll end member, the first scroll wrap having an inner end portion and an inner face, a second scroll wrap formed in a vortical manner and extending from the face of the second end member so as to interdigitate with the first end member, the second scroll wrap having an outer end portion and an inner face, a low gas pressure chamber and a high pressure chamber formed around or in the first and second end members, compressing chambers defined between the first and second scroll wraps, and engaging portions formed on the inner portions of the first and second scroll wraps and each having a guide face, the guide faces of the first and second scroll wraps being formed to remain contacted with the inner end portion of the first scroll wrap and the outer end of the second scroll wrap, respectively, and to guide the respective first and second scroll wraps such that the compressing chambers are moved to compress gas therein stronger during a compressing process of the scroll compressor.

4 Claims, 6 Drawing Sheets

SCROLL COMPRESSOR WITH DISTAL ENDS OF THE WRAPS HAVING SLIDING CONTACT ON CURVED PORTIONS

BACKGROUND OF THE INVENTION

1. Field of the Invention

The present invention relates to a gas compressor, and more particularly to a scroll compressor for compressing a gas by the relative movement between a pair of scroll members.

2. Description of the Related Art

Scroll compressors using scroll members are operated in a low noise and at a high compressing efficiency as well. In general, scroll compressors each using a pair of scroll wraps are classed in the following two types:

The pair of scroll members comprise a pair of scroll wraps relatively orbiting each other.

(1) a scroll compressor in which one of the scroll wraps is orbiting with respect to the other scroll wrap; and (2) a scroll compressor in which both scroll wraps are orbiting with respect to each other.

Both types (1) and (2) of the scroll compressors are also further classed in the following two types in view of their structure:

(A) a scroll compressor in which a bearing portion is provided on the central portion of one of the scroll wraps; and (B) a scroll compressor in which a bearing portion does not exist on the central portion of any one of the scroll wraps.

A general scroll compressor having the bearing portion at the central portion of said one of the scroll wraps, that is, the scroll compressor of a type of (1) (A) or (2) (A) comprises a first end member and a second end member arranged to face each other and making relative movement, a bearing portion extending through the central portion of the second end member to the height of the first end member, a first scroll wrap vortically wound and extending to a surface of the first end member which faces the second end member, a second scroll wrap vortically wound and extending to a surface of the second end member, a gas compressing chamber defined between the first and second scroll wraps and forming the outer region as a low pressure region and the inner region around the bearing portion as a high pressure region, and means for relatively moving the first and second end members.

In the scroll compressor of type (A), bending moment exerted on an axis fitted on the bearing portion is rendered smaller and an auxiliary bearing is more easily provided than in the scroll compressor of type (B).

However, the scroll compressor of type (A) is encountered with the problem that it is difficult to make the volume of the pressure space at the final stage of the compressing cycle small because the bearing portion is formed at the center of the scroll wrap. Consequently, the number of turns of the scroll wraps of the scroll compressor of type (A) must be increased to obtain the same degree of the compression ratio as that of the scroll compressor of type (B), resulting in the drawbacks that the outer diameter of the overall compressor is elevated and the productivity is lowered as well.

Accordingly, the scroll compressor of type (A) must be increased in outer diameter in order to obtain a high compression ratio.

SUMMARY OF THE INVENTION

The object of this invention is to provide a scroll compressor which is provided, at the central portion of a pair of scroll wraps, with a bearing portion and is operated at high compression ratio without increasing the number of turns of the scroll wraps, as compared with the conventional scroll apparatus.

In order to attain the object, the present invention provides a scroll compressor which comprises: a first end member having an axis, a central portion and a face disposed at a first height level; a second end member facing the first end member, relatively movable crosswise of the first end member and having an axis, a central portion and a face opposed to the face of the first end member and disposed at a second level; a bearing portion extending through either one of the central portions of the first and second end members to either one of the second and first height levels; a first scroll wrap formed in a vortical manner and extending from the face of the second scroll end member, the first scroll wrap having an innermost end portion and an inner face; a second scroll wrap formed in a vortical manner and extending from the face of the second end member so as to interdigitate with the first end member, the second scroll wrap having an outermost end portion and an inner face; a low pressure chamber formed around the first and second end members; a high pressure chamber formed in an interior space defined inside of the first and second end members; compressing chambers defined between the first and second scroll wraps and progressively moved from the low pressure chamber to the high pressure chamber by compressing gas in the compressing chambers, as the axes of the first and second end member relatively approach; means for concentrically moving the first and second scroll wraps with respect to each other; and engaging portions formed on the inner portions of the first and second scroll wraps and each having a guide face, the guide face of the first scroll wrap and the guide face of the second scroll wrap being formed to remain contacted with the innermost end portion of the first scroll wrap and the outermost end of the second scroll wrap, respectively, and to guide the respective first and second scroll wraps such that the compressing chambers are moved to compress a gas therein stronger and stronger during a compressing process of the scroll compressor.

The innermost end portion of the first scroll wrap and the outermost end portion and second scroll wraps which are adjacent to the bearing portion remain slidably contacted with the inner faces of the other scroll wraps through a predetermined orbital angle measured from the point at which the tips begin to contact the scroll wraps. Assuming that the contacting range is between 0° and 180°, compression action can be continued in this range, in principle. This renders the volume of the compression space narrower at the final stage of the compression cycle than in the case of the conventional scroll compressor in which end member of the scroll wraps opposed the other scroll wraps instantaneously. This structure visualizes a high compression ratio without increasing the number of the turns of the scroll wraps, resulting in suppressing the enlargement of the outer diameter without the reduction of the compressing efficiency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
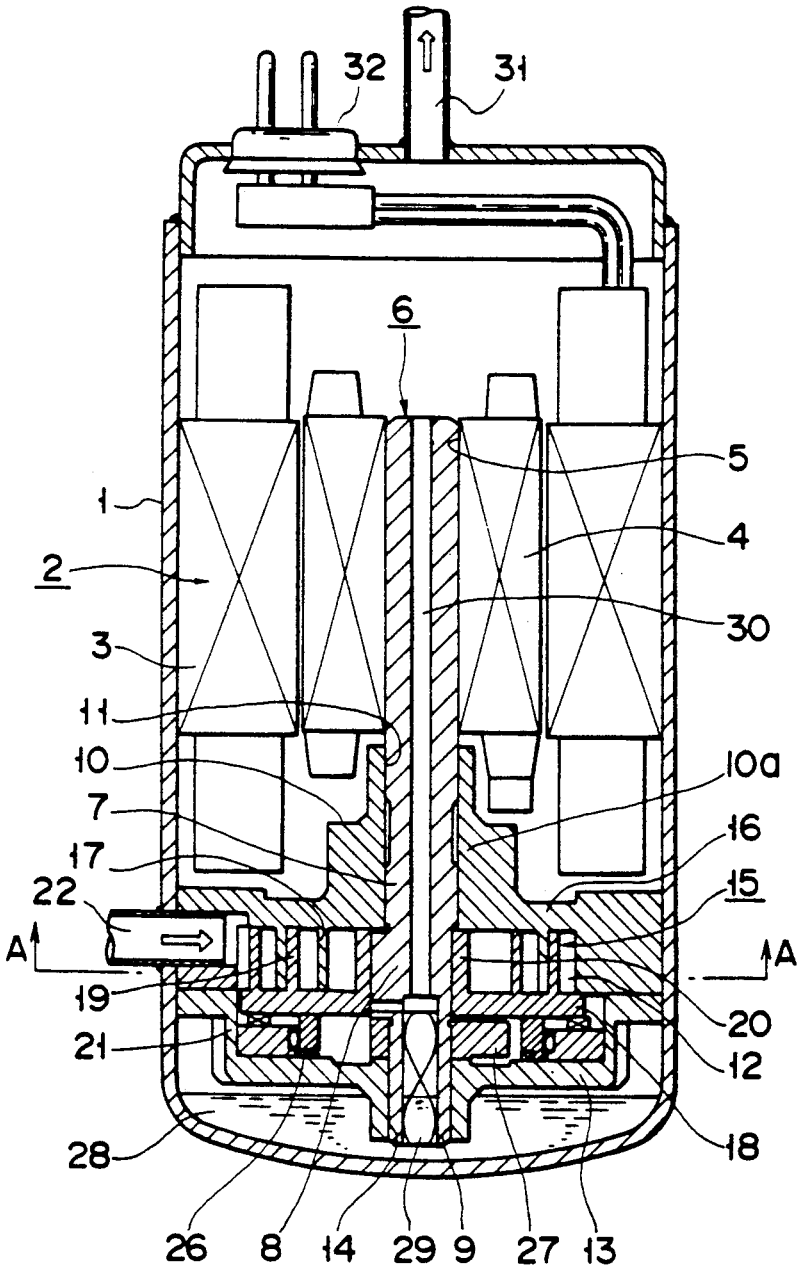
FIG. 1 is a longitudinal cross-sectional view of an embodiment of the scroll compressor according to the present invention.

In FIG. 1 is shown one embodiment of the scroll compressor having a high pressure housing.

A motor 2 is disposed in the upper portion of an elongated, hermetically sealed case 1. The motor 2 is of an induction motor and comprises a stator 3 fixed to the inner face of the hermetically sealed case 1, with the axis of the stator directed vertically, and a rotor 4 rotatably provided in the stator 3 with the driving shaft 6 of the rotor set in coaxial relation therewith. A hole 5 coaxially extends through the rotor 4. The upper portion of the driving shaft 6 is pressingly inserted in the hole 5 so as to be fixed to the rotor 4. The driving shaft 6 comprises a main shaft portion 7, a crank shaft portion 8 formed eccentric with the main shaft portion 7 and an auxiliary shaft portion 9 provided coaxial with the main shaft portion 7 such that these shaft portions 7 to 9 are aligned with one after another vertically, as shown in FIG. 1. The lower portion of the main shaft portion 7 is supported by a bearing 11 formed in a first frame 10.

The first frame 10 is fixed at its outer periphery to the inner face of the hermetically sealed case 1. Under the first frame 10 is provided a second cylindrical bottomed frame 13 in which is formed a space 12 hermetically sealed by the first frame 10. The second frame 13 is connected at its peripheral portion to the first frame 10 by means of fixing means such as bolts (not shown). In the lower boss of the second frame 13 is formed a bearing 14 for supporting the auxiliary portion 6 of the driving shaft 6.

A compressing mechanism 15 which is rotated by means of the driving shaft 6 is placed in the space 12 defined between the first frame 10 and the second frame 13.

Figure 2A:
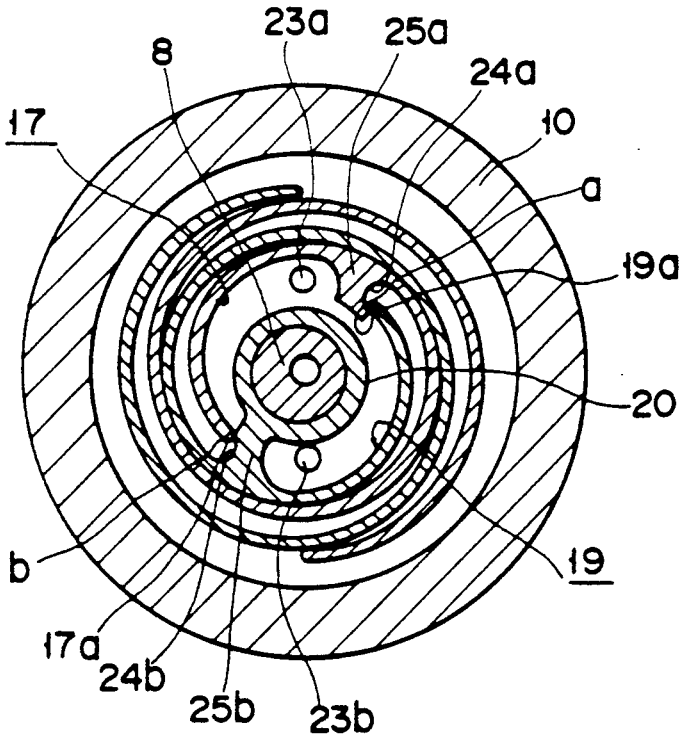
FIG. 2A is a cross-sectional view of the main portion of the scroll compressor along arrow line 2A—2A in FIG. 1 and observed in the direction of the arrows.

The compressing mechanism 15 comprises a fixed end member 16 formed on the lower end of the first frame 10 and having a depression opening downward, a fixed scroll wrap 17 having a vortical form comprising the combination of involute curve **17*b* and semi-circle 17*a* and integrally formed on the bottom face of the depression in the fixed end member 16, an orbiting end member 18 disposed in the lower portion of the space 12 so as to face the fixed end member 16, an orbiting scroll wrap 19 extending upward from the upper surface of the orbiting end member 18 having the same height and the vortical form as the fixed scroll wrap 17, a crank bearing portion 20 formed as high as the bottom face of the depression in the fixed end member 16 on the central portion of the orbiting end member 18 so as to be fitted in the crank shaft portion 8 of the driving shaft 6, an Oldham mechanism 21 provided between the orbiting end member 18 and the second frame 13, a gas pipe 22 extending through the lateral wall portion of the fixed end member 16 and the lateral wall of the hermetically sealed case 1, for guiding a gas to be compressed to the hermetically sealed case 1, outlet passages 23*a* and 23*b* formed on both sides of the driving shaft 6 and extending through the boss portion 10*a* of the first frame 10 and the fixed end member 16, as shown in FIG. 2A**.

Figure 2B:
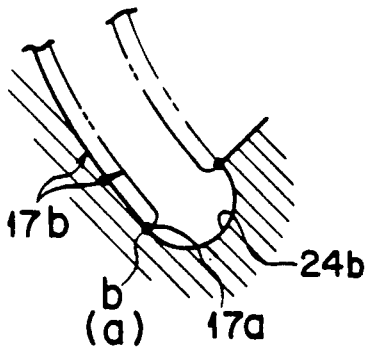
FIG. 2B is a magnification view of an end portion of the wrap.

The fixed scroll wrap 17 and the orbiting scroll wrap 19 will now be described with reference to FIG. 2.

At the beginning of the gas compression by the scroll wraps 17 and 19, only the innermost end portion **17*a* (hereinafter referred to as the "tip portion") of the fixed scroll wrap 17 contacts at a point b with the inner face of the orbiting scroll wrap 19, and only the outermost end portion 19*a* (hereinafter also referred to as the "tip portion") of the orbiting scroll wrap 19 contacts at a point a with the inner face of the innermost end portion of the fixed scroll wrap 17. An engaging portion 25*a* is formed on that part of the inner face of the fixed scroll wrap 17 which is adjacent to the point a and an engaging portion 25*b* bridging the outer surface of the crank shaft portion 20 and the orbiting scroll wrap 19 is formed on that part of the inner face of the orbiting scroll wrap 19 which is adjacent to the point b. On those sides of the engaging portions 25*a* and 25*b* which face the tips 19*a* and 17*a* of the scroll wraps 19 and 17, respectively, are integrally formed guide surfaces 24*a* and 24*b* which are adapted to be continually slidably contacted by the tip portions 19*a* and 17*a* of the second and first scroll wraps 19 and 17 while the driving shaft 6** rotates through a predetermined orbital angle (substantially 180° in this embodiment).

The radius of curvature R of the guide faces **24*a* and 24*b*** is defined by:

$$R=r+t/2$$

where r is the maximum radial displacement of the tip portions **17*a* and 19*a* of the scroll wraps 17 and 19, and t is the thickness of the scroll wraps 17 and 19**.

The motor 2 is supplied with electric power from the terminal box 32 to start the rotation of the rotor 4. The driving shaft 6 is also rotated by the operation of the rotor 6.

In the driving shaft 6, the axis of the crank shaft portion 8 is eccentric to the axes of the main shaft portion 7 and the auxiliary shaft portion 9. The crank shaft portion 8 is fitted in the crank bearing portion 20 provided in the moving crank portion 8.

Through the Oldham coupling 21, the rotation of the driving shaft 6 revolves the orbiting scroll wrap 19 around the axis of the driving shaft 6 substantially without rotating the moving scroll shaft 19 around itself. In the process of gradually decreasing the volumes of the compressing chambers, this movement causes two compressing chambers defined between the scroll wraps 17 and 19 to be displaced from the outer side to the inner side of the scroll wraps 17 and 19 (that is, toward the central portion of vortices). As the compressing chambers are moved and the volumes of the compressing chambers are changed, a low pressure gas introduced in the compressing chambers through the gas pipe 22 is gradually compressed. In other words, one cycle of the gas compression in the two compressing chambers is completed when the driving shaft 6 makes one revolution or the moving scroll wrap 19 makes a orbital movement in the order of the processes as shown from FIGS. 3A to 3D. A graph indicating the capacity ratio of the compressing chambers at the each orbital angles of the compressing processes is shown in FIG. 8 for easy understanding of this invention.

The tip portions 19*a* and 17*a* of the second and first scroll wraps 19 and 17 begin to contact at the point a and b with the inner faces of the scroll wraps 19 and 17, respectively. The tips 19*a* and 17*a* slide on the guide surfaces 24*a* and 24*b* until the driving shaft 6 rotates through 180°. As the driving shaft 6 rotates further, the tips 19*a* and 17*a* are disengaged from the guide surfaces 25*a* and 25*b* of the engaging portions 24*a* and 24*b*. The volumes of the compressing chambers are rendered smaller at the final stage than at the initial stage, and the gas in the compressing chambers are compressed to exhibit the highest pressure at the final stage. As the moving scroll wrap 19 is moved, the compressed, highly pressurized gas is discharged from the outlet passages 23*a* and 23*b* and introduced into the hermetically sealed case 1 therethrough, such that the interior of the hermetically sealed case 1 is filled with the compressed gas. The highly pressurized gas is discharged from the hermetically sealed case 1 through the gas tube 31 communicating with the outer atmosphere.

Figure 3A:
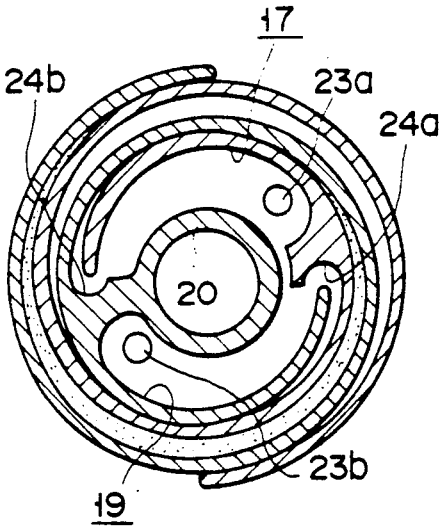
FIGS. 3A to 3D are cross-sectional views of the main portion of the scroll compressor, illustrating the compressing processes in a simplified manner.
Figure 3B:
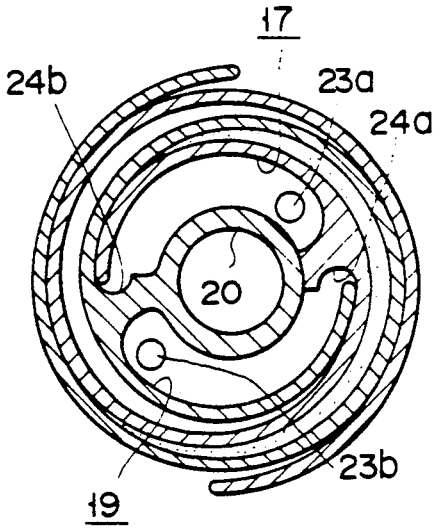
Figure 3C:
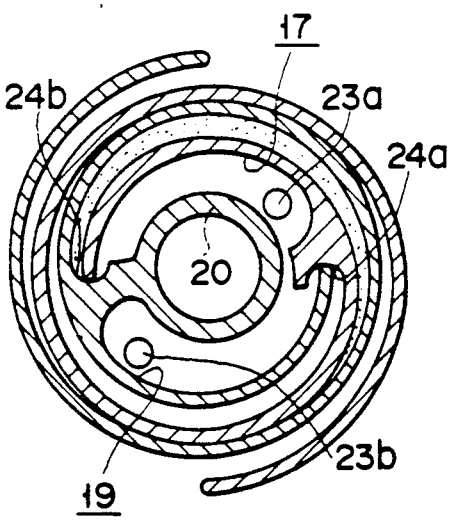
Figure 3D:
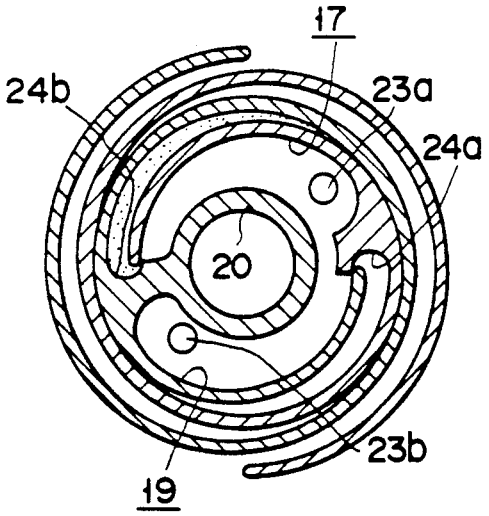
Figure 8:
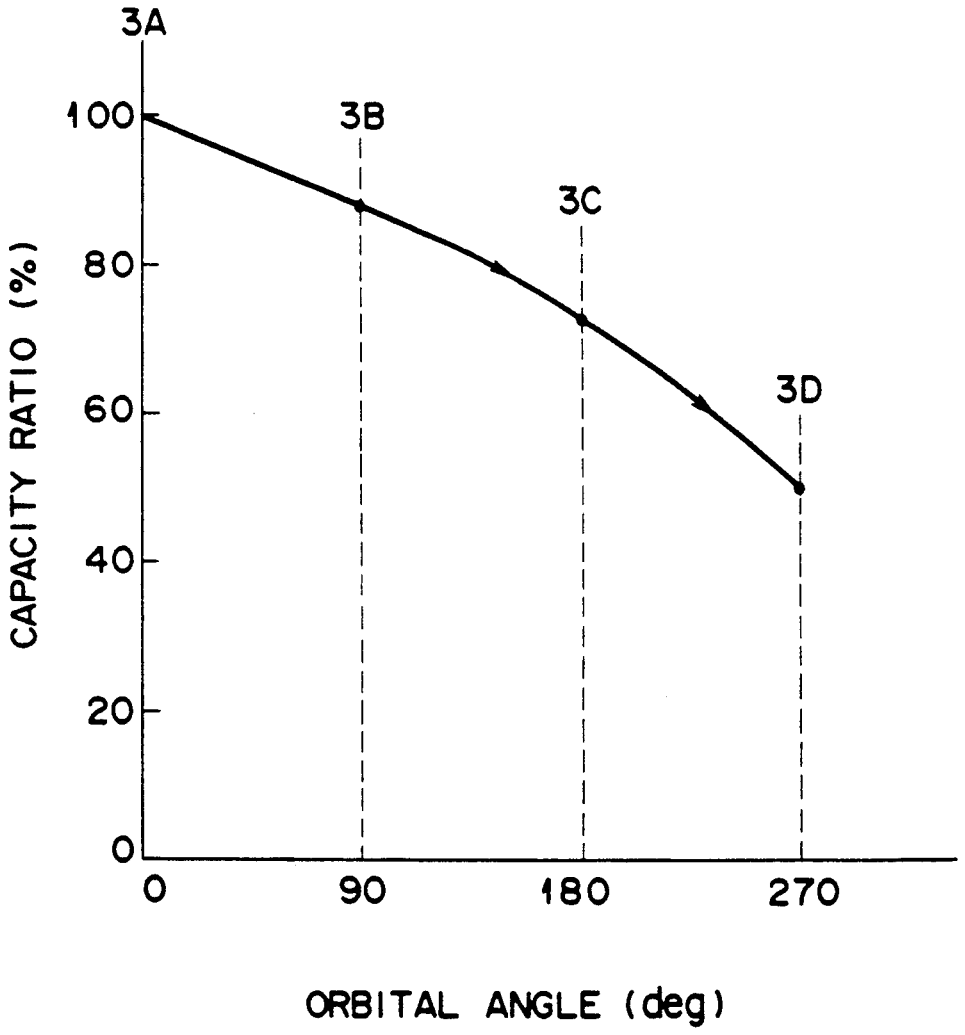
FIG. 8 is a graph showing the relation between the capacity ratio and the orbital angles of the end portion the scroll wraps due to the rotational angles of a motor in the compressing processes as shown from FIGS. 3A to 3D.

As shown in FIG. 8, the gas volume in the compressing process in the conventional scroll compressor changes when the driving shaft rotates through 0° to 90°, this process occurring in a state similar to FIG. 3B. In this invention, the compressing process can be extended to the state in which the driving shaft is rotated through 0° to 180° (corresponding to FIG. 3C) and further to the state in which the driving shaft is rotated through 0° to 270° (corresponding to FIG. 3D), thus improving the compression ratio.

The guide faces 24*a* and 24*b* are integrally formed on the engaging portions 25*a* and 25*b* on the inner faces of the scroll wraps 19 and 17, such that the tip portions 19*a* and 17*a* of the scroll wraps 19 and 17 remain contacted with the guide faces 24*a* and 24*b*, respectively, when the driving shaft 6 rotates through the angle from a position at which the tip portions 19*a* and 17*a* begin to contact the inner faces of the scroll wraps 19 and 17 at the points a and b, respectively, to a position at which the tip portions 19*a* and 17*a* begin to leave the guide faces 24*a* and 24*b*. This structure renders the volumes of the compression chambers smaller than the structure of the conventional scroll compressor in which the tip portions of the scroll wraps are instantaneously engaged with and disengaged from the inner faces of the opposed scroll faces, and thus improved gas compressing ratio can be obtained without increasing the number of the turns of the scroll wraps. In consequence, the increase of the outer diameter of the rotating system of the scroll compressor such as the scroll wraps can be suppressed, and the scroll compressor can be readily manufactured.

Figure 4:
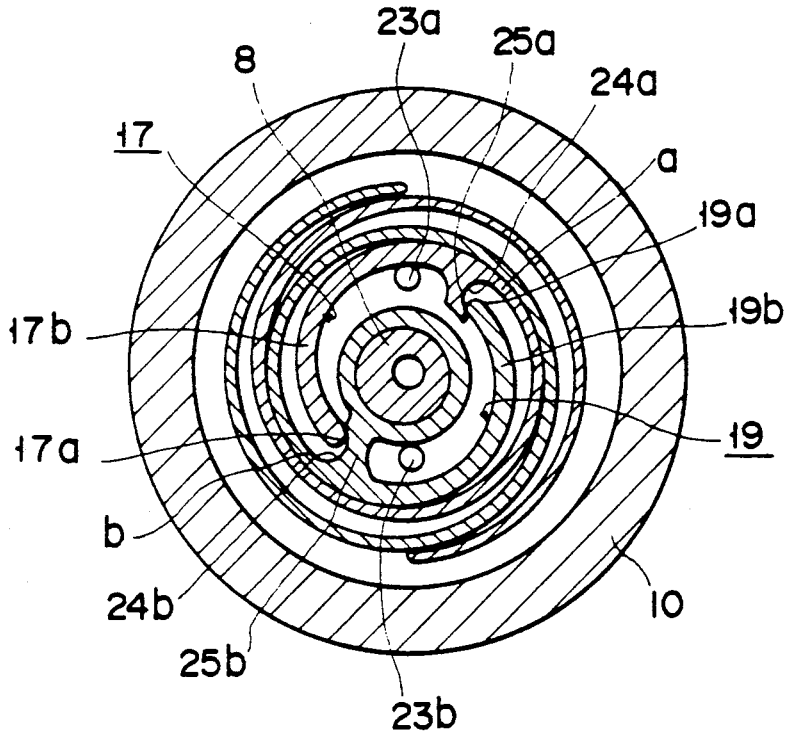
FIG. 4 is a cross-sectional view of the main portion of the scroll compressor according to another embodiment of the present invention.

FIG. 4 shows a cross-sectional view of the main portion of the scroll compressor of another embodiment of this invention. The same elements and parts of this embodiment as those of the first embodiment are shown by the same referential numerals, the description thereof being omitted.

In this second embodiment, the tip portions 19*a* and 17*a* of a orbiting scroll wrap 19 and a fixed scroll wrap 17 are made thicker than those of the first embodiment, and the radius of curvature R of a guide faces 24*a* and 24*b* are made larger than those of the first embodiment accordingly.

The same technical effect as the first embodiment can be attained by this second embodiment. Further, the mechanical strength of the tip portions 19*a* and 17*a* can be enhanced. Still further, the sealing capacity of the guide faces 24*a* and 24*b* can be much improved with the increased radius of curvature R.

Figure 5:
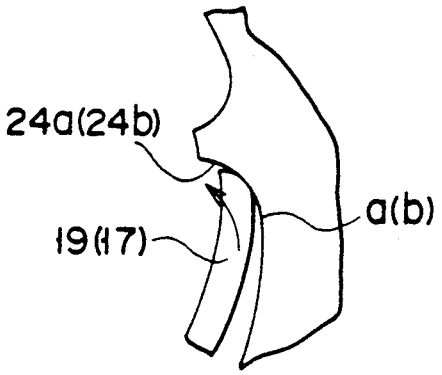
FIGS. 5 to 7 are enlarged cross-sectional views of the end member of the modifications of the present invention.
Figure 6:
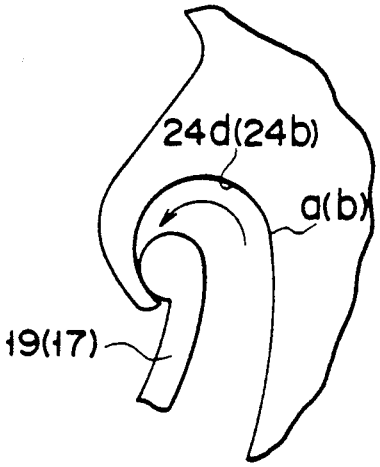
Figure 7:
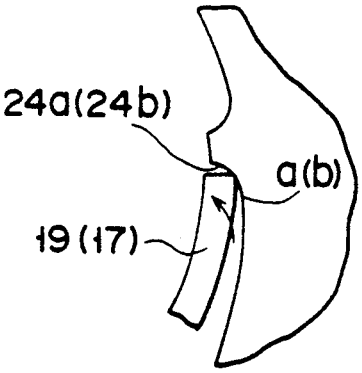

In this embodiment, the compressing angle of the driving shaft 6 or the angle extended between the starting and final points on the guide faces 24*a* and 24*b* is substantially 180°, but the angle may be 90° which is a quarter of the full rotational angle of the driving shaft 6, as shown in FIGS. 5 and 7. Further, the angle can be extended to more than 180° as shown in FIG. 6. However, the angle is not always limited to a special one but any angle may be selected according the number of the turns of the roll wraps and the like.

Both the scroll wraps can be eccentrically moved with respect each other. Further, the positions of the fixed scroll wraps and the orbiting scroll wrap can reversed such that the orbiting scroll end member is disposed closer to the motor than the fixed scroll end member.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A scroll compressor comprising:

a first end member and a second end member disposed so as to be facing each other, said first and said second end members being capable of making an orbital motion with respect to each other;

a bearing member extending through a center portion of said second end member to the level of said first end member;

a first scroll wrap extending, in vortical manner, from a surface of said first end member which faces said second end member, said first scroll wrap having a distal end which is located near said bearing member;

a second scroll wrap extending, in vortical manner, from a surface of said second end member which faces said first end member, said second scroll wrap having a distal end which is located near said bearing member, and interdigitating with said first end member in an axial direction, thereby defining a gas-compression chamber between said first and second end members, a peripheral portion of said first and second end members is a low-pressure space and a portion around said bearing member is a high pressure space; and drive means for driving at least one of said first and second end members, thereby causing said first and second end members to make an orbital motion with respect to each other, wherein a portion of the inner surface of said first scroll wrap, which is in sliding contact with the distal end of said second scroll wrap, and a portion of the inner surface of said second scroll wrap, which is in sliding contact with the distal end of said first scroll wrap, are arcuately curved such that said distal ends of said first and second scroll wraps remain in sliding contact with said portions of the inner surfaces of said first and second scroll wraps, from the time the distal ends start sliding on said portions of the inner surfaces, over a predetermined range of angle by which said first and second end members make an orbital motion with respect to each other.

2. The compressor according to claim 1, wherein said predetermined range of angle is more than 0° to less than 180°.

3. The compressor according to claim 1, wherein said predetermined range of angle is more than 0° to less than 90°.

4. The compressor according to claim 1, wherein said predetermined range of angle is more than 0° to less than 270°.

* * * * *